US006220909B1

(12) United States Patent
Aschauer et al.

(10) Patent No.: US 6,220,909 B1
(45) Date of Patent: Apr. 24, 2001

(54) AVALANCHE LIFE SAVING SYSTEM

(75) Inventors: Peter Aschauer, An der Dorfwiese 3, D-82166 Graefelfing; Helmuth Bauer; Ulricke Bauer, both of Malgersdorf, all of (DE)

(73) Assignee: Peter Aschauer, Graefelfing (DE)

( * ) Notice: Subject to any disclaimer, the term of this patent is extended or adjusted under 35 U.S.C. 154(b) by 0 days.

(21) Appl. No.: 09/363,460

(22) Filed: Jul. 29, 1999

Related U.S. Application Data

(63) Continuation of application No. PCT/EP98/00491, filed on Jan. 30, 1998.

(30) Foreign Application Priority Data

Jan. 31, 1997 (DE) ..... 19703656.2

(51) Int. Cl.[7] ..... B63C 9/00
(52) U.S. Cl. ..... 441/80; 441/92; 441/136
(58) Field of Search ..... 441/80, 87, 92, 441/136, 86, 38, 40–42

(56) References Cited

U.S. PATENT DOCUMENTS 659,807 * 10/1900 Barton ..... 441/87
3,768,467 * 10/1973 Jennings ..... 441/38
4,365,628 * 12/1982 Hodel ..... 128/205.12
4,635,754 1/1987 Aschauer .
4,943,252 * 7/1990 Manix et al. ..... 441/87

FOREIGN PATENT DOCUMENTS 2558303 7/1977 (DE) .
19516872A 11/1996 (DE) .
2674761A 10/1992 (FR) .
2081660A 2/1982 (GB) .
84 01300 4/1984 (WO) .

* cited by examiner

*Primary Examiner*—Stephen Avila
(74) *Attorney, Agent, or Firm*—Helfgott & Karas, P.C.

(57) ABSTRACT

An avalanche life saving system has at least one inflatable buoyancy body of balloon design secured close to a user's body, a filling unit, a compressed gas unit with a compressed gas container and a release mechanism capable of actuation without a tool and attached to said compressed gas unit via a quick coupling and a release tubing. Compressed gas is transmitted to the buoyancy body via the filling unit upon actuation of the release mechanism. Actuation of the release mechanism produces a controlled pressure wave, which starts the flow of compressed gas from the compressed gas container to the filling unit.

25 Claims, 9 Drawing Sheets

AVALANCHE LIFE SAVING SYSTEM

This application is a continuation of PCT/EP 98/00491 filed Jan. 1, 1998.

The present invention concerns an avalanche life saving system which has at least one inflatable buoyancy body secured close to the body of a user, one filling unit, one compressed gas unit with a compressed gas container and one release mechanism.

Many skiers, snowboarders and hikers usually depart from marked trails to obtain a thrilling adventure with nature. This enjoyment can quickly turn into a life-threatening situation if persons going through deep snow are caught on a break-away slope or if they set-off a sheet of snow. Almost all persons survive a fall with masses of snow. Only 7% die due to shock or injuries caused by such falls. About 90% of all avalanche victims can be saved within a period of 15 min. from being buried alive. One may survive longer with free respiratory passages, and after 30 to 45 min. they only survive if there are additional air pockets. In order to prevent being buried alive and to improve the chances of survival in an avalanche, avalanche life saving systems of the kind mentioned herein were developed. Their mode of operation consists in that the user is caused to be swept upwards by the masses of snow due to auxiliary volumes placed close to the body to prevent being buried alive and to eliminate the risk of asphyxiation.

Thus, for example, in European Patent Specification 0123684 there is described a device for saving persons in avalanches using a. tear-resistant balloon which is secured close to the body of the user via an attachment and which in an emergency is inflated by means of compressed gas so that, like a buoyancy body, keeps its user at the surface of the avalanche. This life saving device has a filling device to which one or several compressed gas cylinder(s) is (are) connected and which is connected in series with a nozzle arrangement operating according to the Venturi principle. In addition, the device described has a rigid housing of cup-shaped design which is secured to the user via straps. When filling the balloon, ambient air is drawn in through the openings of the housing connected to the environment, and thus the compressed gas cylinder can have a correspondingly smaller volume.

In World Patent Application WO96/35479 there is described a life saving device which has two tear-resistant balloons which can be secured close to the body of the user by means of an attachment and which in an emergency are inflated by means of compressed gas. The filling device, which connects the balloon to the compressed gas container, has a device to open the compressed gas container. The compressed gas container with the filling device is secured independent of the balloon to the body of the user. The filling device is connected to the balloon for pure gas filling.

The disadvantage of both above described devices is that these either have to be strapped by means of a separate harness, over an existing backpack. If one desires access to the backpack it is necessary to take off the life saving device. When integrating the life saving device in a backpack, the filling device requires considerable space and the access to the backpack is made more difficult. In the case of pure gas filling, the extra weight of the compressed gas cylinder provides additional weight which makes both devices hard to handle and only reluctantly are brought along by the user.

The object of the present invention is therefore to provide a space-saving, light-weight avalanche life saving system which can be integrated as directly as possible in a backpack system which is safe, reliable and yet inexpensive.

The prior art problem is solved by means of an avalanche life saving system with the characteristic features of claim 1, and a method to fill such an avalanche life saving system according to claim 11. In this case, the avalanche life saving system has a filling unit, each of which is arranged, in a space-saving manner, inside the buoyancy body or the buoyancy bodies. Besides the smaller pack sizes for the buoyancy body (bodies) with integrated filling unit, this arrangement has in addition the advantage that the filling unit and the compressed gas cylinder can be arranged separate from one another whereby the filling unit and the compressed gas unit can be arranged spatially in such a way that they do not inconvenience the user. Furthermore, in this way the filling unit is shielded from the user whereby injuries caused by protruding parts, are avoided. The compressed gas unit has a connection to the release unit, which can take place, for example, by means of compressed gas tubing or a cable pull or lever system, and connection possibilities for the compressed gas tubings to the filling units of the buoyancy bodies. The essential part of the compressed gas unit is the accommodation for the compressed gas cylinder and the opening device for the seal of the compressed gas cylinder. Advantageously, the compressed gas unit has in addition a fastening device to attach the same securely and firmly in a place provided therefor. Thus, for example, the integration of the compressed gas unit with the compressed gas container in the back of a backpack is particularly advantageous where this is attached via tear-resistant straps to the force-transferring fibres of the backpack. The force transfer from the buoyancy body via the backpack to the user takes place in this case via the backpack harness which is designed for the expected high forces which occur in an avalanche. As a result of this, no additional harness is needed whereby the use is made easier. The buoyancy body or bodies is (are) packed in the backpack in such a way that upon triggering, only a velcro fastener has to be undone by means of the pressure of the inflating buoyancy body or bodies. The release mechanism can advantageously be placed in the front, and attached to a carrying strap or integrated in the latter.

According to a preferred further advantage of the invention, the release mechanism can be removed, without any tool, from the release tubing representing the connection to the compressed gas unit. In particular for this purpose, the release grip provided as the release mechanism can be connected via a quick coupling to the release tubing. The detachability of the release mechanism makes it possible to avoid unintentional triggering or erroneous triggering. The user of the system then only hooks up the release grip when he enters the relevant terrain. The release grip is not hooked up beforehand, in particular on mountain cableways, on trains, in restaurants, in buses, on trails. In this way, a triggering of the system is ruled out. Furthermore, the release mechanism can be secured alternatively or additionally against unintentional triggering by means of, for example, a velcro strip.

A particularly further advantage resides in that the filling unit has an ejector nozzle. The compressed gas flows through this nozzle at high velocity. In this way, additional drawing in of ambient air is made possible during the filling operation of the buoyancy body which results in a smaller quantity of compressed gas being necessary whereby the weight of the avalanche life saving system can be reduced significantly. This contributes considerably to the comfort of carrying the avalanche life saving system.

A further advantage resides in that the ejector nozzle (250) is surrounded by a casing (260) provided with holes (261) whereby a two-stage ejector effect is produced.

In addition, it is advantageous that the filling unit integrated, in the buoyancy body is provided with a non-return valve connected. with the environment. When starting the filling operation, compressed gas first flows through the ejector nozzle into the buoyancy body and brings about a preliminary filling of the latter. In the course of this, the non-return valve is still closed. The buoyancy body is freed from the storage space and the vacuum produced by the inflowing compressed gas brings about the opening of the non-return valve. The ejector effect of the nozzle provides for a constant drawing in of ambient air. The buoyancy body has in the inflated state a mixture of compressed gas and ambient air. Nitrogen can be used, for example, as compressed gas. When reaching a certain filling stage, the ejector effect subsides and the non-return valve closes again whereby an escape of the gas mixture from the buoyancy body is prevented.

An advantageous embodiment of the present invention provides that the filling unit has a vent valve to evacuate manually the buoyancy body. As a result of this, the avalanche life saving system can be returned again after use to an easily transportable state, that is, the buoyancy bodies can be folded again and placed in the storage compartments. In this case, it is advantageous if the vent valve is integrated in the non-return valve. This contributes to space saving and a reduction in weight.

An advantageous embodiment provides that a combined non-return and vent valve is arranged on the filling unit.

The compressed gas unit has advantageously a device to open the compressed gas container. This can be, for example, a needle to pierce the cap of the compressed gas container. The needle in this case is designed in such a way that, after the piercing of the cap, it is pushed out of the compressed gas container or that the compressed gas can flow through or around it. In this case, the pertinent opening device can be actuated either by compressed gas, a spring pressure, a mechanical lever system or by cable pulls. Besides flattened needles, hollow puncture pins or strikers can also be used.

A further advantage of the present invention resides in that the compressed gas unit is connected, via a compressed gas tubing, with the filling unit. By means of the integration of the filling unit in the buoyancy body, the drawing-in of the air takes place directly on the spot because no special design tubing for a gas-air mixture is required. By using compressed gas tubings which only are connected with the compressed gas container, a non-return valve is not required in this area.

A particularly advantageous further feature of the present invention provides that the release mechanism has a chamber to produce a controlled pressure wave. Common blank cartridges with gunpowder and also nitrogen cartridges can be used. In this case, the release mechanism can be designed in such a way that the cartridge in a slide is hurled against a pin, as well a striker can be hurled against a percussion cap of a stationary cartridge. The pressure wave set off in this way is led via a compressed gas tubing to the compressed gas unit. The advantage of such a release mechanism is that no complicated use of Bowden wire or levers is necessary whereby mechanical failure, such as, jamming of a Bowden wire is almost ruled out. For the triggering, any current devices for firing blank cartridges can be used. However, an electric triggering via wire or by wireless transmission can also be used.

Advantageously, the release mechanism (8) is designed as a grip for the release by a pulling force. As additional safety precaution, such a grip can have an indication which shows the state of the charge. In this way, the user is warned before bringing along a "spent" avalanche life saving system.

The buoyancy body has the advantage in that the cover consists of foldable, tear-resistant and gastight material. The latter can, for example, consist of rubberized fabric, or laminated foil or tear-resistant balloon fabric. The buoyancy body can have any suitable form such as, a balloon, a cushion or be of a cigar shape. However, a simple tube shape also can suffice.

Another advantage resides in that the buoyancy body (2, 3) has a gastight balloon (219) inside the cover (218). Due to such a two-chamber design, the buoyancy body can be folded or "crumpled" significantly smaller whereby the size of the pack is reduced. The balloon in this case can consist, for example, of PU coated polyamide fabric while the cover material can be thicker, uncoated polyamide fabric.

Another advantage resides in that the present invention provides that the cover and balloon fabric of the buoyancy body is connected gastight to the valve opening of the filling unit. This can, for example, be achieved by clamping the cover and balloon fabric gastight between a serrated sealing ring and a pressure plate by means of screws or rivets.

It is a particular advantage that the two buoyancy bodies protrude on the sides beyond the body of the user. This provides for the buoyancy bodies to be packed in more convenient places, and secondly altogether the buoyancy surface is increased since the body of the user likewise serves as a dynamic buoyancy surface. In the event of the release of the avalanche life saving system during the start of a fluid avalanche, this brings about a "sliding" on the surface of the snow masses. Another advantageous effect of the arrangement of the buoyancy bodies on the sides resides in that the skier or snowboarder is hardly restricted in his freedom of movement whereby an attempt to escape the approaching avalanche is still possible. The head of the user also is protected against injuries by the buoyancy bodies on the sides protruding beyond the head. By exploiting the dynamic buoyancy effect, the total volume of the buoyancy bodies can be reduced, which contributes considerably to the reduction of the weight as well as the size of the pack. Two buoyancy bodies have an additional safety function since in the case of damage or malfunction of one of the two buoyancy bodies, the remaining buoyancy body still provides sufficient buoyancy.

Finally, another advantage of the present invention is that the compressed gas unit of the avalanche life saving system is integrated in the back of a backpack and the buoyancy bodies are connected to the backpack on the sides. This increases the carrying comfort and makes access to the backpack possible without having to remove the avalanche life saving system or to clear parts of the latter out of the way. Close body contact by the buoyancy bodies prevents the user from sinking deeply into the avalanche.

A covering screen in front of the intake opening of the filling unit prevents the penetration of snow, ice or other foreign bodies into the filling unit, for example during a fall, and this may cause seizure of the non-return valve which would prevent a malfunction of the filling unit. The screen can be a bar screen, mesh or fleece and can consist, for example, of synthetic material, synthetic fibres or metal wire. The method to fill an avalanche life saving system of the present invention has the following steps:

a) manual actuation of the release mechanism whereby a pressure wave is set off;

b) automatic opening of the compressed gas container by means of an opening device;

c) automatic preliminary filling of the buoyancy body with compressed gas whereby the former unfolds from the storage space;

d) automatic opening of the non-return valve of the filling unit;

e) drawing in of ambient air by means of the ejector effect of the filling unit, and complete filling of the buoyancy body.

The present invention is described in detail by means of an exemplified embodiment with reference to the attached drawings in which.

Figure 1:
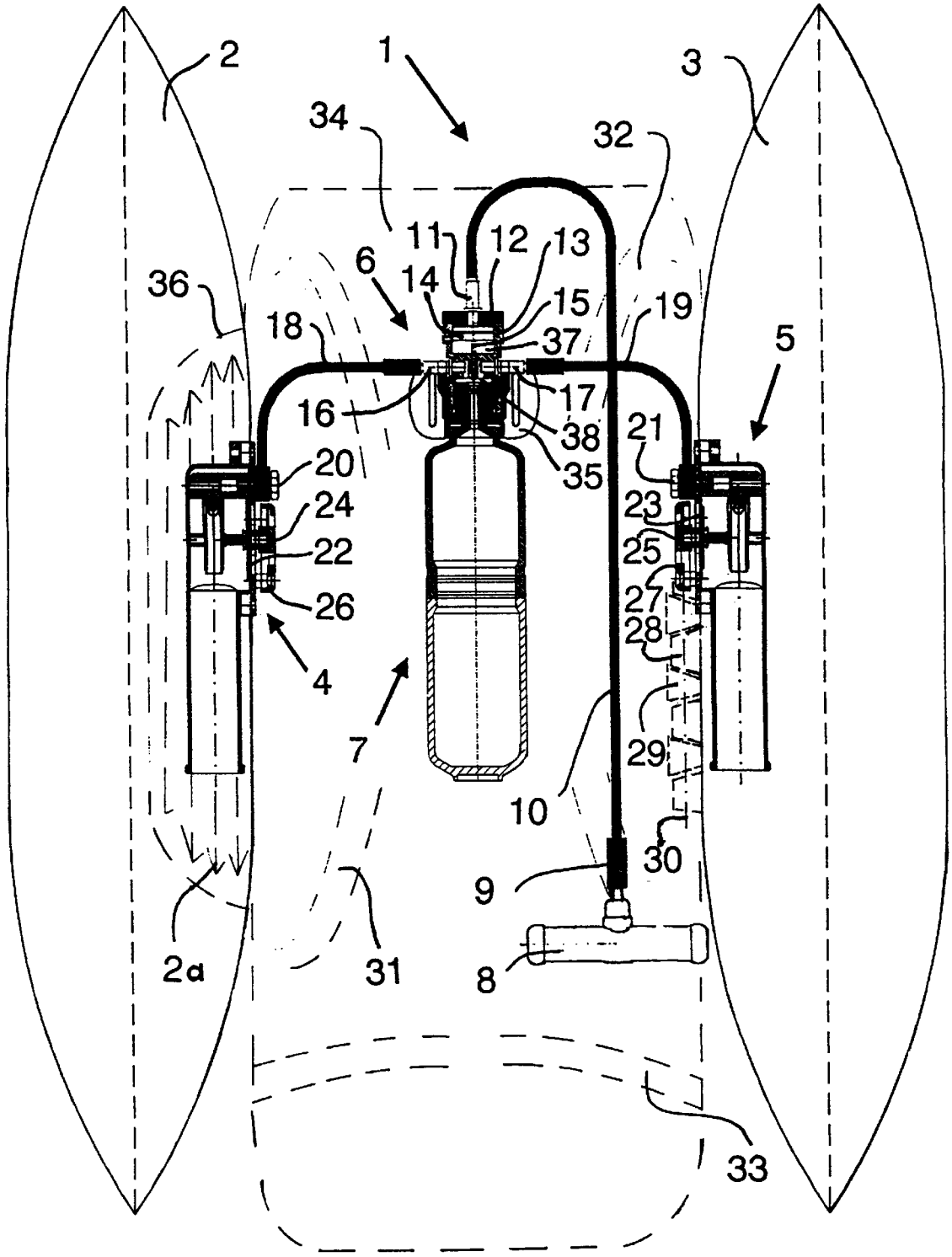
FIG. 1 is a schematic overall view of the avalanche life saving system.

Referring to the drawings, FIG. 1 shows a schematic overall view of an avalanche life saving system 1 which is secured on a backpack 34 indicated by broken lines. The representation shows two cigar-shaped buoyancy bodies 2, 3 in inflated state, filling units 4, 5, a central compressed gas unit 6, a compressed gas container 7 as well as a release mechanism 8. The buoyancy bodies 2, 3 have in the present exemplified embodiment a volume of 751 each. The release mechanism 8 is connected via a quick coupling 9 to a release tubing 10 which is integrated (not shown) in one of the carrying straps 31, 32. The release tubing 10, in the form of compressed gas tubing, is designed for high pressures (up to about 600 bar). It is connected by means of a connecting piece 11 at the end opposite the quick coupling 9 to the cap 12 of the compressed gas unit 6. The base component 13 of the compressed gas unit 6 consists essentially of a cylindrical machined metal piece which has at both its end sections, cylindrical hollow spaces 37, 38, arranged in the longitudinal direction. Both hollow spaces 37, 38 are connected with one another via a bore. The cap 12 is screwed gastight to an end section of the cylindrical hollow space 37 in which there is a piston 14 displaceable in the longitudinal direction of the base component. To the piston 14, a needle 15 is connected which protrudes into the bore between the two cylindrical hollow spaces 37, 38 of the base component 13. The second cylindrical hollow space 38 has an internal thread to accommodate the locking cap of the compressed gas container 7. The compressed gas unit 6 and the compressed gas container 7 are integrated in the back of the backpack 34 and attached to the latter via attachment straps which are connected to the supporting plate 35. Accommodations for the connecting pieces 16, 17 are arranged in the centre section of the base component 13. The connecting pieces 16, 17 are connected to compressed gas tubings 18, 19 (for pressures up to about 600 bar) each of which are connected via connecting pieces 20, 21 to the filling units 4, 5. The filling units 4, 5 are disposed inside the buoyancy bodies 2, 3 and have each, besides the compressed gas connecting piece 20, 21, a non-return or vent valve 22, 23. The valves 22, 23 can be opened manually by pushing in the cylindrical bodies 24, 25. The filling unit 4, 5 consists essentially of synthetic material and is connected gastight to the cover of the buoyancy body 2, 3. The cover of the buoyancy body 2, 3 has at the level of the valve 22, 23 a circular opening which in each case is covered leakproof on the inside by the non-return valve and which on the outside has a cover screen 26, 27 for protection against penetrating snow. The material of the buoyancy bodies 2, 3 consists of gas impermeable, tear-resistant and foldable fabric and is connected to the backpack 34 via loops 28, which each intermesh zipper-like with loops 29 attached to the backpack, and a metal rod 30 extending through the loops (only shown on one side). Furthermore, the side storage pocket 36 with the folded buoyancy body 2*a* therein in broken lines is shown on one side only.

If the user of the avalanche life saving system 1 is caught in a fluid avalanche, the user activates the release mechanism 8 by a pulling force whereby a pressure wave is set off which through the release tubing 10 acts on the piston 14 in the compressed gas unit 6. The piston 14 is displaced in the direction of the centre of the base component 13 whereby the needle 15, connected to the piston 14, pierces the locking cap of the compressed gas container 7. The compressed gas, nitrogen in the present case, at a pressure of about 200 bar presses the piston with the needle back in and flows through the connecting pieces 16, 17 and the compressed gas tubings 18, 19 into the filling units 4, 5. The inflowing compressed gas first provides for a preliminary filling of the buoyancy bodies 2, 3 whereby the latter are freed from their side storage pockets and expose the non-return valves 22, 23. The vacuum produced by the inflowing compressed gas causes the non-return valves 22, 23 to open whereby additional ambient air is drawn in. The filled buoyancy bodies 2, 3 have thus in the inflated state a mixture of compressed gas and ambient air. In the present exemplified embodiment, the two buoyancy bodies 2, 3 are arranged on the sides of the backpack whereby they do not hinder the skier in his escape from a triggered avalanche. In addition, in the event of a fall, the buoyancy surface is increased significantly by the arrangement of the buoyancy bodies 2, 3 on the sides which makes a safe sliding possible on the fluid avalanche. Reliable close body contact of the buoyancy bodies 2, 3 with the user is ensured via the backpack straps 31, 32 and the waist strap 33. The force-carrying seams of the backpack are designed for particularly high forces in order to ensure the reliable function of the avalanche life saving system.

Figure 2:
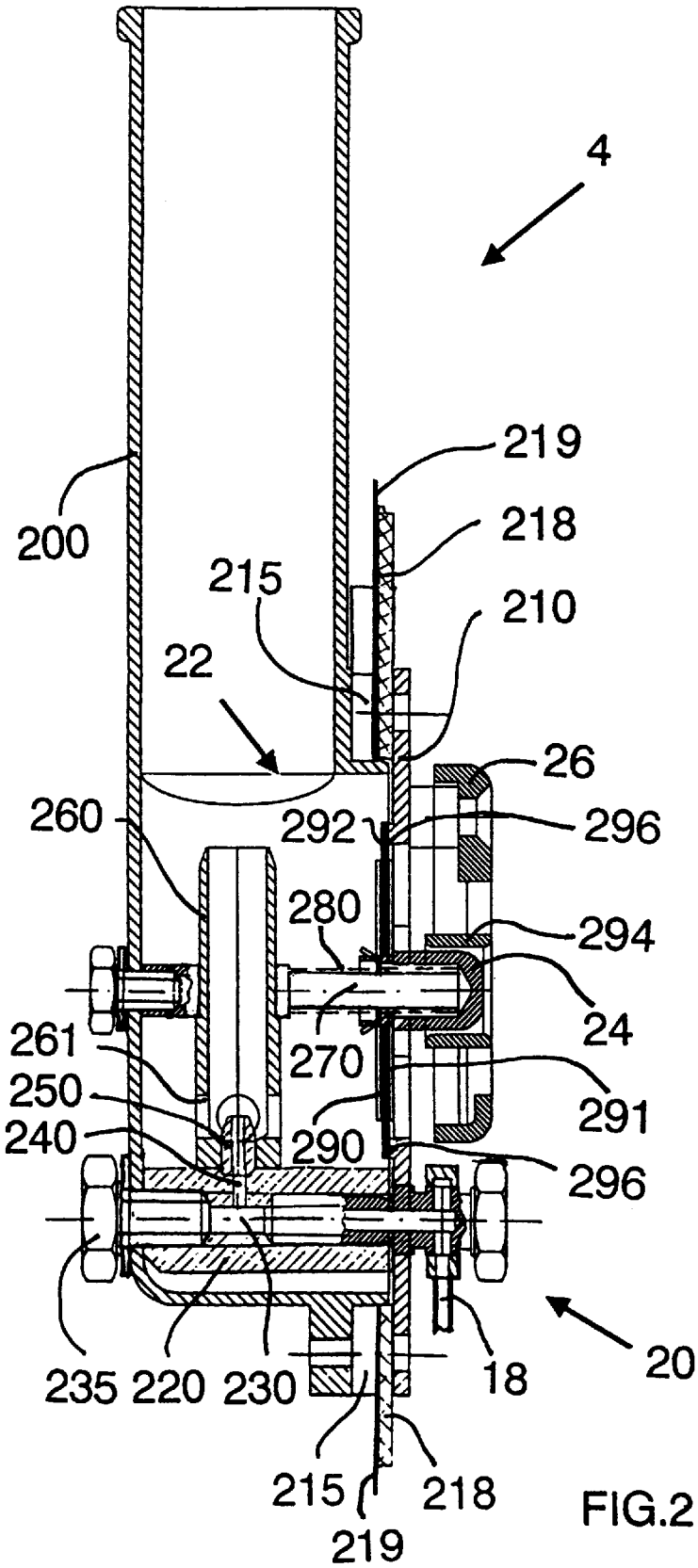
FIG. 2 is a section view through an embodiment of the filling unit according to the invention with a closed non-return valve.
Figure 3:
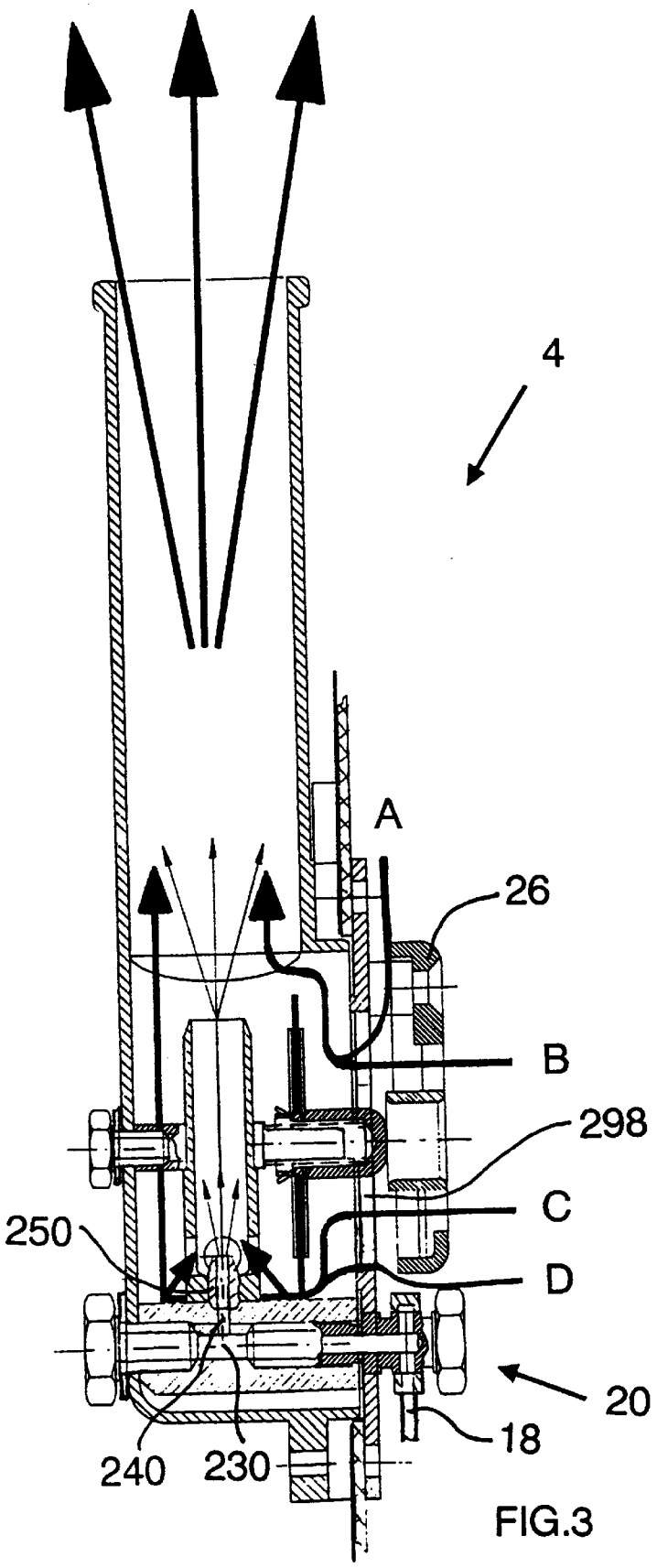
FIG. 3 shows the filling unit in FIG. 2 with opened non-return valve.

FIGS. 2 and 3 show the filling unit 4 with the plastic housing 200, the cover plate 210, the covering screen 26, the compressed gas connection 20 and the non-return or vent valve 22. In the interior of the housing 200, a base plate 220, made of metal, is arranged which has a through hole 230 as well as a bore 240. The hole 230 is closed at one end by the sealing screw 235 and attaches in this way the base plate to the housing and is at its other end connected to the compressed gas connector 20. The hole 230 is connected through the bore 240 to the nozzle 250 arranged on the base plate. The casing 260 is disposed concentrically with the nozzle 250. In its bottom third, the casing has four bores 261 distributed over the periphery. At the centre level of the casing 260, the non-return or vent valve 22 is supported on the latter. The valve 22 consists of a guide rod 270 which is surrounded by a spring 280. The spring projects into the bore 285 of the cylindrical body 24 which is displaceable in the longitudinal direction of the guide rod 270. At the periphery of the cylindrical body 24, the circular rubber packing ring 292, held between two circular metal plates 290, 291, sits in a slot. The cylindrical body 24 is guided on the outside of the housing by a cylindrical sleeve 294 of the covering screen 26. The fabric cover 218 and the balloon fabric 219 of the buoyancy body 2 are screwed or riveted gastight between the cover plate 210 and a gasket ring 215. The cover plate 210 and the gasket ring 215 have an intermeshing serration which offers additional protection against the slipping out of the fabric cover 218 and 219 (not shown). The diameter of the cover opening in the present exemplified embodiment is about 4 cm. The height of the filling unit is about 14 cm.

At rest, the rubber packing ring 292 is pressed by the spring pressure of the spring 280 against the encircling sealing edge 296. During the filling operation, the compressed gas is led in from the compressed gas tubing 18 via the compressed gas connector 20, the hole 230 and the bore 240 into the nozzle 250. The inflowing compressed gas brings about first a slight preliminary filling of the buoyancy body whereby the latter automatically is freed from the side storage pocket. The vacuum occurring due to the flow velocity of the compressed gas brings about the opening of the non-return valve 22 against the spring pressure of the spring 280 (FIG. 3). By means of the ejector effect of the nozzle 250, ambient air is drawn in via the opened non-return valve 22 through the covering screen 26 (arrows A, B, C, D). In the course of this, a two-fold ejector effect occurs since the air flow drawn-in through the holes 261 intensifies the ejector effect of the compressed gas at the exit of the casing 260. With subsiding flow velocity of the compressed gas, the ejector effect decreases and the valve 22 closes again. As a result, an escape of the gas mixture from the inflated buoyancy body is prevented. By pressing on the body 24, the valve 22 can be opened manually and the buoyancy body thus can be vented.

Figure 4:
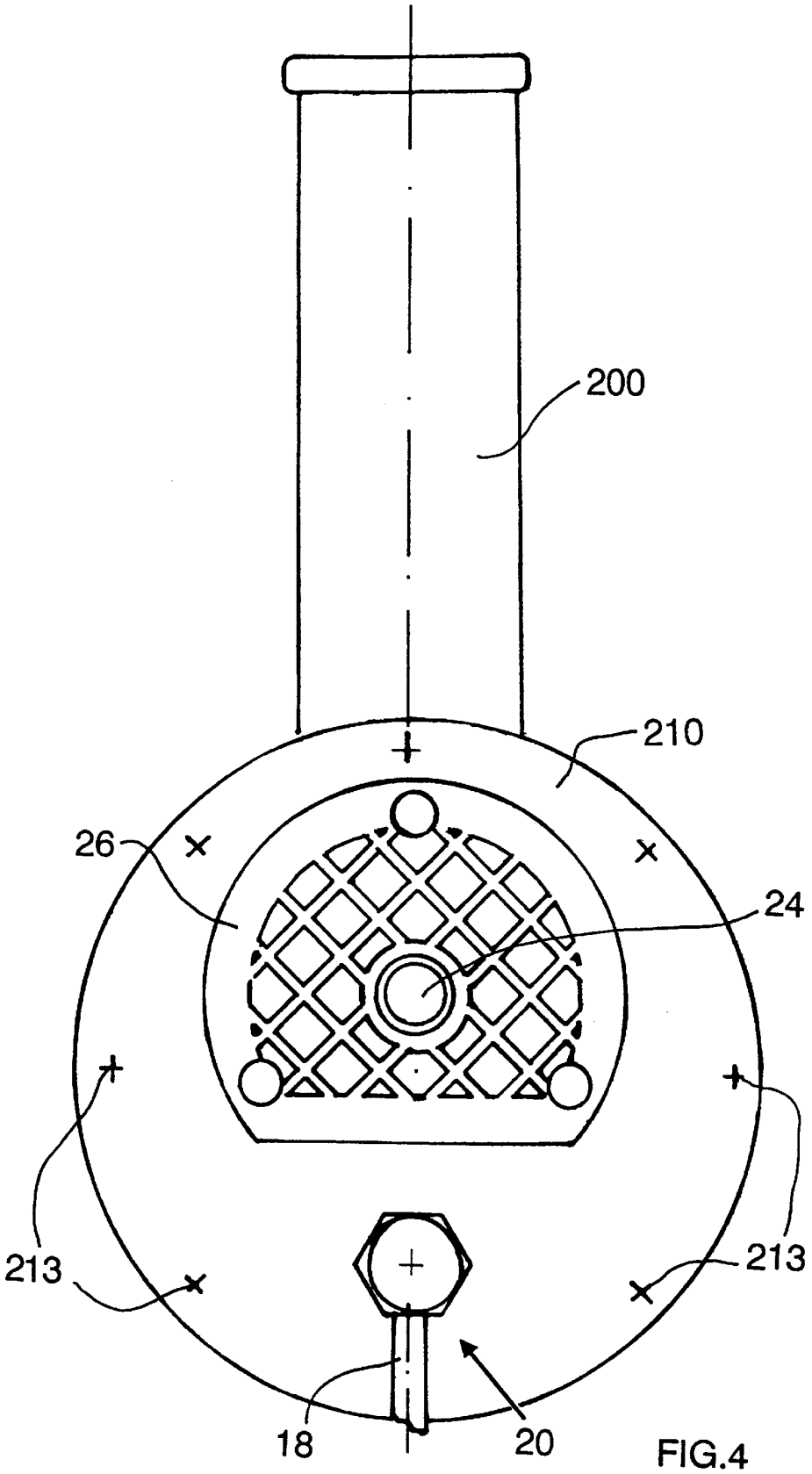
FIG. 4 shows a side view of the filling unit of FIG. 2.

FIG. 4 shows a side view of the filling unit 6 in FIG. 2. Besides the housing 200, the cover plate 210, the covering screen 26, the cylindrical body 24 as well as the compressed gas connector 20 with the compressed gas tubing 18 are shown. The cover plate 210 is bolted by means of screws or rivets 213 against the gasket and clamps in this way clamps the fabric cover.

Figure 5:
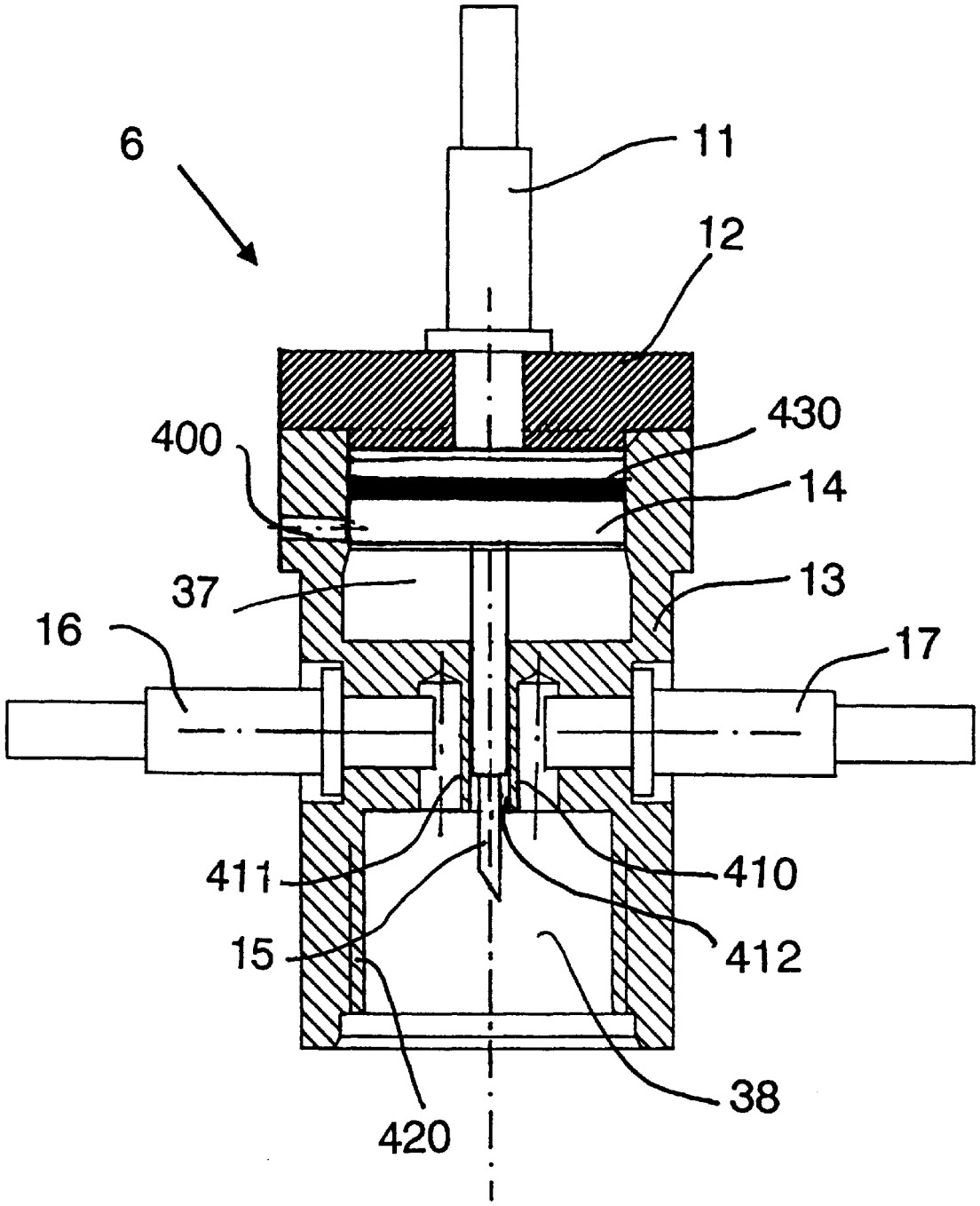
FIG. 5 is a section view through an embodiment of the compressed gas unit with the opening device in normal position.
Figure 6:
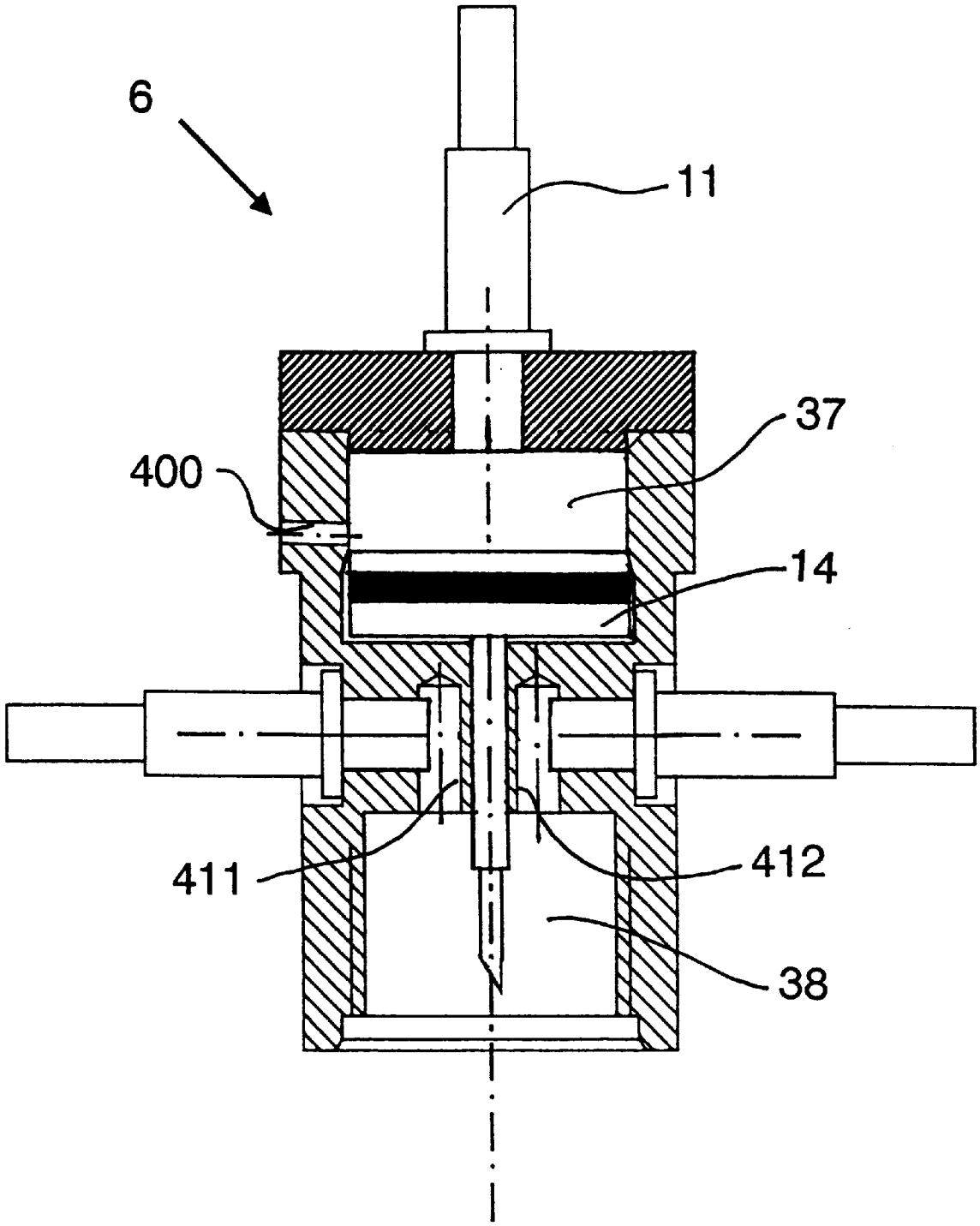
FIG. 6 shows the compressed gas unit of FIG. 5 in a triggered state.

FIGS. 5 and 6 show the compressed gas unit 6 with the cap 12, the piston 14, the needle 15 and the connecting pieces 11, 16, 17. The piston 14 has an O-ring 430 as a piston packing. For stabilization and guidance, the needle 15 has a large diameter, and in the area of the point, a smaller diameter. The needle 15 is flattened on one side so that gas can flow alongside it.

The base component 13 made by machining has in the outside wall of the hollow cylindrical section, in which the piston 14 is guided, a vent hole 400. Moreover, the base component 13 has in its centre section two blind bores 410, 411 and the central throughhole 412 through which the needle 15 is guided. The cylindrical hollow space 38, for the accommodation of the compressed gas container, has an internal thread 420.

The pressure wave produced by the release mechanism arrives via the connecting piece 11 in the cylindrical hollow space 37 of the compressed gas unit 6. There the piston 14 is displaced so far by the pressure wave until the needle 15, connected to the piston 14, has pierced the locking cap 500 of the compressed gas container. In this position, the piston 14 frees the vent hole 400 whereby the pressure wave produced by the release unit can escape to the environment. The compressed gas flowing from the compressed gas container now presses the needle and the piston back again into their starting position. As a result of this, the locking cap opening becomes free to the point that compressed gas can flow into the blind bores 411, 412 from where it can arrive in the connecting pieces 16, 17 and from there, via compressed gas tubings 18, 19, in the filling units 4, 5.

Figure 7:
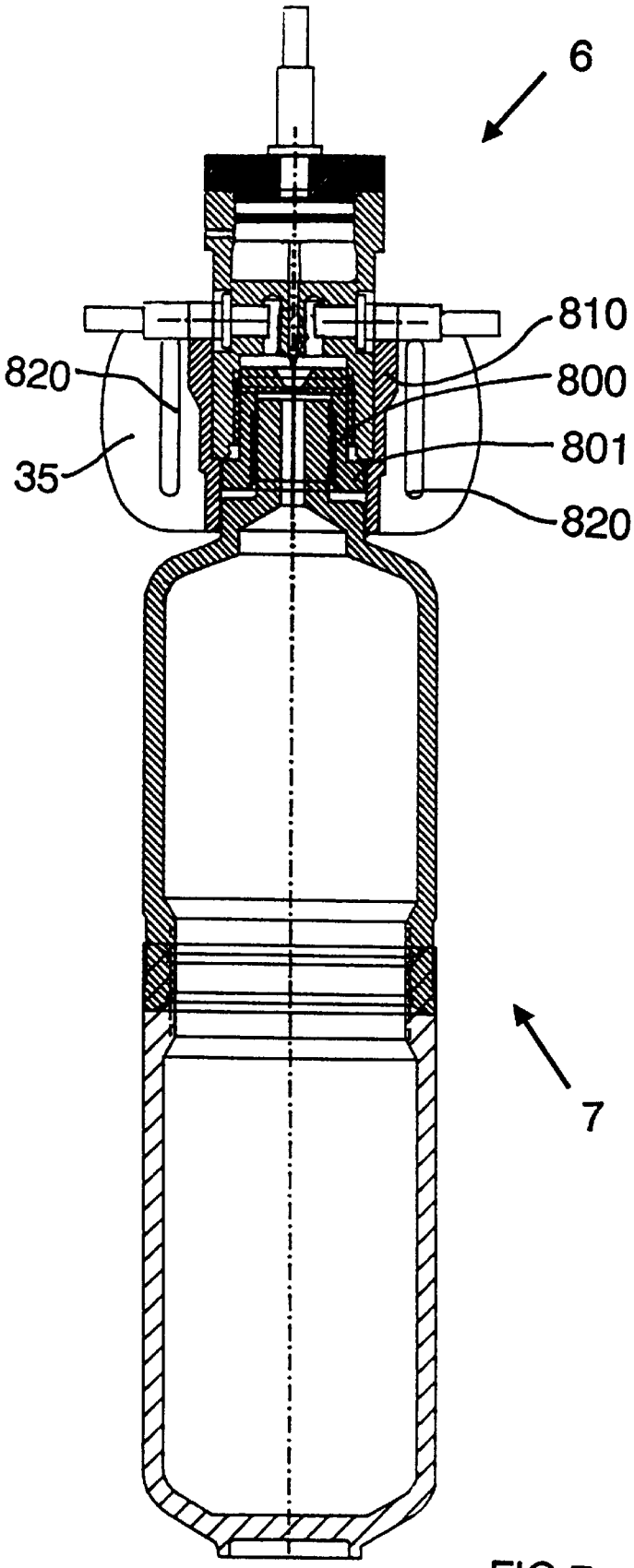
FIG. 7 shows the compressed gas unit with the connected compressed gas container.

FIG. 7 shows the compressed gas unit 6 with compressed gas container 7 which is designed as a two-piece compressed gas cylinder of machined aluminium construction. The compressed gas container 7 has a cap 800, provided with internal and external thread, with guide collar 801. The screw collar ring 810 in conjunction with the collar 801, brings about a centring of the compressed gas container 7 when screwed into the thread 800 whereby damage of the same is avoided. Furthermore, the collar 801 prevents the compressed gas container 7 from being screwed in too far and thus undesired opening of the locking cap. Furthermore, the compressed gas unit 6 is connected to the supporting plate 35 by means of a screw collar ring 810 through the elongated slots 820 of which fastening straps are provided to attach the compressed gas unit 6 in the back of the backpack.

Figure 8:
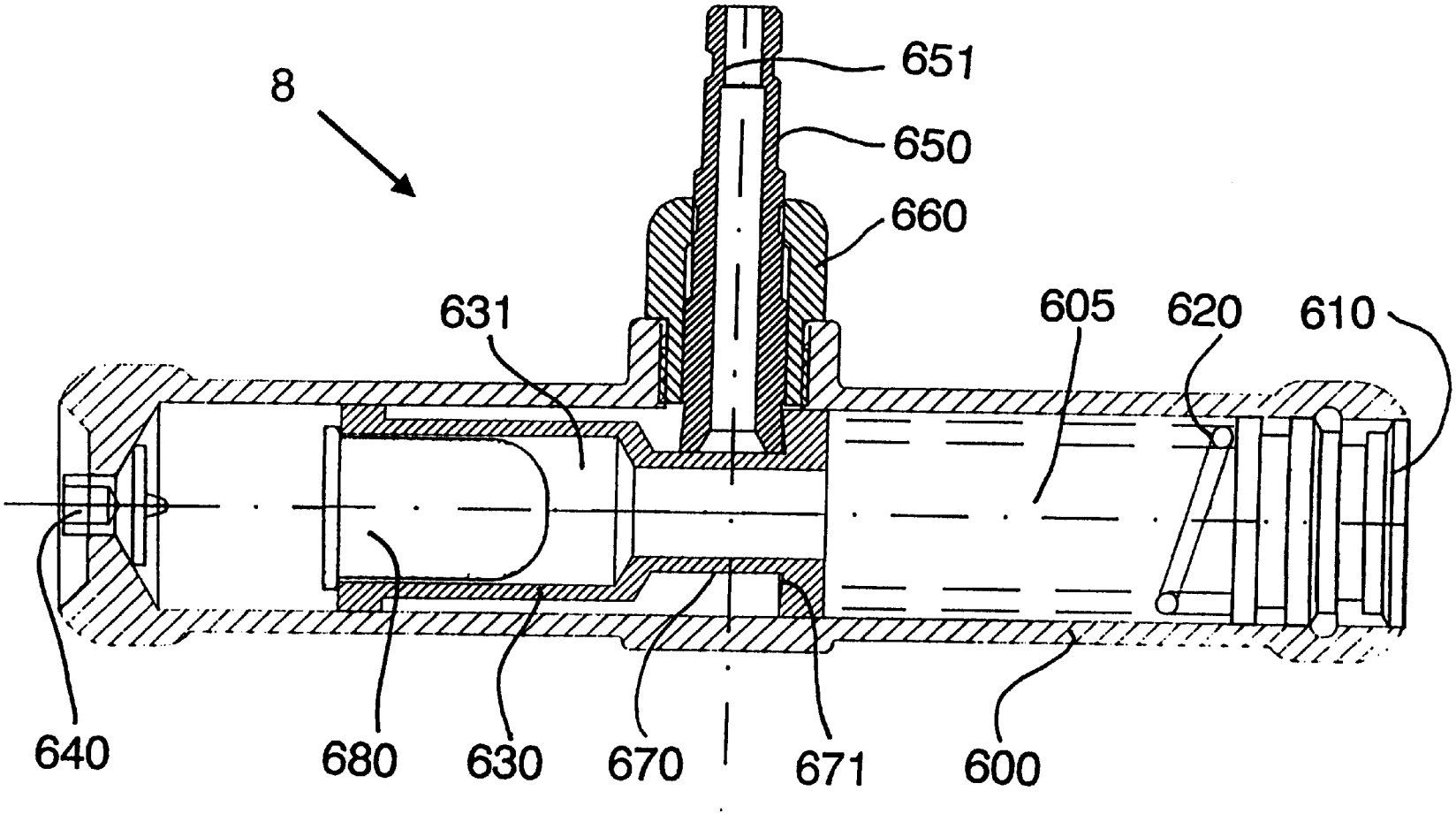
FIG. 8 is a section view through an embodiment of the release mechanism in its cocked state.
Figure 9:
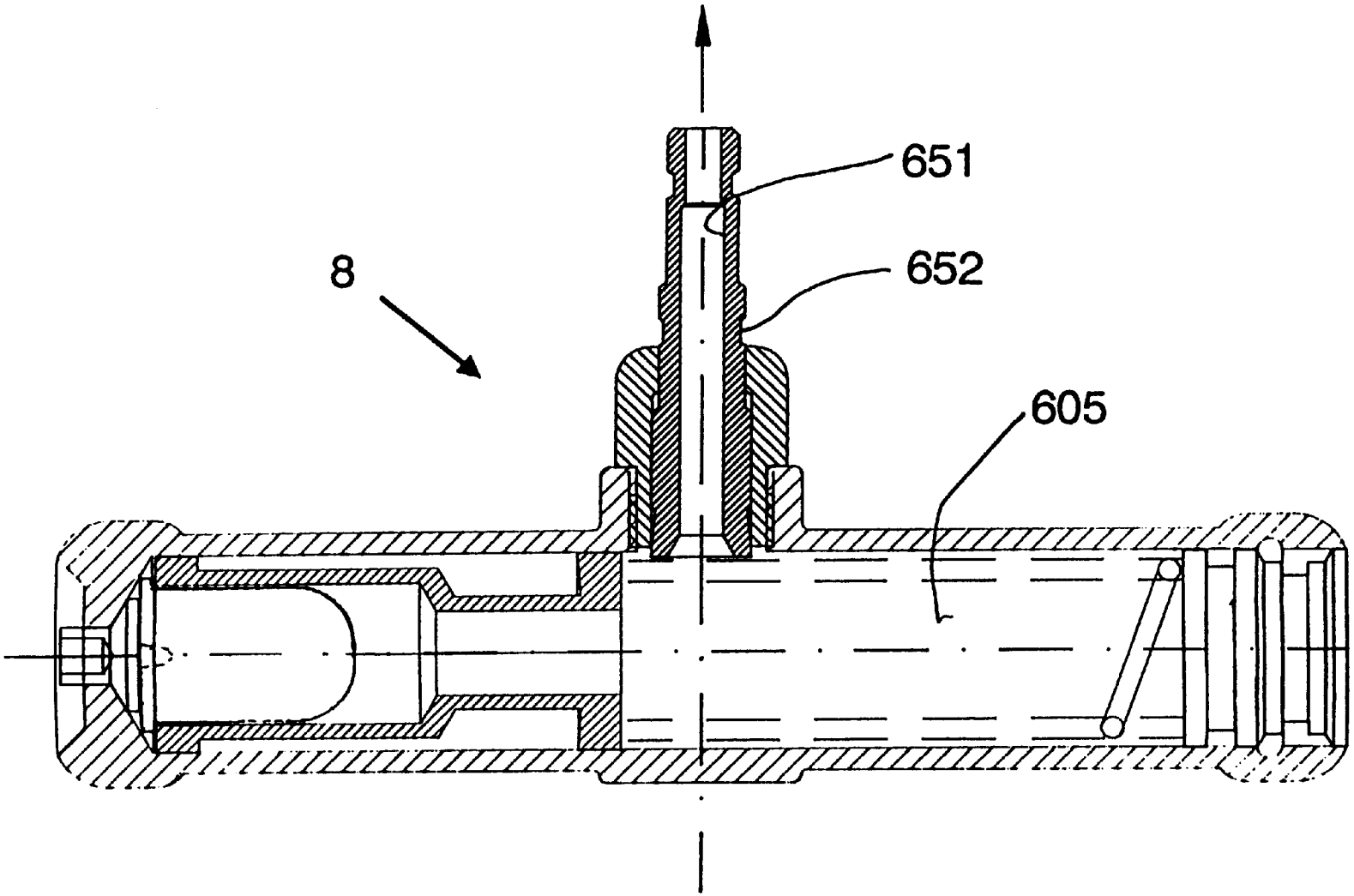
FIG. 9 shows the release mechanism of FIG. 8 in a triggered state.

FIGS. 8 and 9 show a section through the release mechanism 8 in which case FIG. 8 shows the release mechanism in the cocked state and FIG. 9 the release mechanism is shown in the triggered state. Both figures show the metal housing 600 having a hollow cylindrical design, the locking cap 610, the spring 620, the slide 630, the pin 640 as well as the plug 650 which travels in a guide 660 and has a through-hole 651. The slide 630 has an undercut 671 in the area of the slot 670 to accommodate the plug 650. By means of this undercut 671, the plug 650 in the cocked state as shown in FIG. 8, is prevented from slipping out by itself from the accommodating slot 670. In addition, the force which is needed to move the plug 650 out of the accommodating slot 670 is determined by the depth of the undercut. Still further, the slide 630 has a cartridge chamber 631 in which a blank cartridge 680 is accommodated. When actuating the release mechanism 8, the housing 600, which is designed as a grip, is pulled in the direction opposite to the plug 650 so that the latter slips out of the accommodating slot 670 and the slide 630 is hurled due to the spring pressure towards the pin 640 (FIG. 9). When the blank cartridge 680 strikes the pin, the cartridge is fired and the pressure wave set off in this way can arrive in the release tubing through the plug 650. In the shown exemplified embodiment, a 9 mm blank cartridge filled with gunpowder is used. The initial tension in the spring 620 can be adjusted by the screw-in depth of the cap which makes it possible to have a more reliable release of the blank cartridge. The slot 652 has a red marking by means of which the user knows that the release mechanism is in the triggered state as soon as this is visible, as shown in FIG. 9. Through suitable design the plug 650 is prevented from sliding back whereby the red marking always remains visible in the "fired" state. The cocking is carried out by removing the cap 610 whereby the spring 620 is released and the slide can be removed. A new cartridge is then inserted and the slide is brought to the position in which the plug 650 is inserted in the accommodating slot. The spring 620 is then again tensioned by the cap 610. The hollow cylindrical plug 650 is connected via the release tubing with the compressed gas unit 6.

What is claimed is:

1. An avalanche life saving system comprising:

at least one inflatable buoyancy body of balloon design secured close to a user's body, a filling unit mounted inside the at least one inflatable buoyancy body, said filling unit further comprising an ejector nozzle to draw in ambient air, a compressed gas unit with a compressed gas container, and a release mechanism, wherein said ejector nozzle is surrounded by a casing which is provided with holes whereby a two-stage ejector effect is produced.

2. An avalanche life saving system according to claim 1, wherein said filling unit further comprises a non-return valve connected with the environment.

3. An avalanche life saving system according to claim 1, wherein said filling unit further comprises a vent valve to manually vent said at least one buoyancy body.

4. An avalanche life saving system according to claim 2, where said filling unit further comprises a vent valve to manually vent said at least one buoyancy body such that a combined non-return and vent valve is provided.

5. An avalanche life saving system according to claim 1, wherein the compressed gas unit further comprises a device for opening said compressed gas unit.

6. An avalanche life saving system according to claim 1, further comprising a compressed gas tubing for connecting said compressed gas unit to said filling unit.

7. An avalanche life saving unit system according to claim 1, wherein said release mechanism further comprises a chamber to produce a controlled pressure wave.

8. An avalanche life saving system according to claim 7, wherein the release mechanism further comprises a pull grip for release by a pulling force.

9. An avalanche life saving system according to claim 1, wherein said at least one buoyancy body further comprises a cover formed of foldable, tear-resistant material.

10. An avalanche life saving system according to claim 1, wherein said at least one buoyancy body further comprises a gastight balloon inside a cover thereof.

11. An avalanche life saving system according to claim 6, wherein said at least one buoyancy body further comprises a cover and a balloon fabric which are connected gastight to a valve opening of said filling unit.

12. An avalanche life saving system according to claim 1, further comprising two buoyancy bodies protruding on the sides beyond the body of a user.

13. An avalanche life saving system according to claim 2, wherein said compressed gas unit is integrated in the back of a backpack and said buoyancy bodies are connected to opposed sides of said backpack.

14. An avalanche life saving system according to claim 1, further comprising a covering screen secured in front of a valve of said filling unit to prevent penetration of foreign bodies into said filling unit.

15. An avalanche life saving system according to claim 1, wherein said release mechanism is attached via a quick coupling, which can be actuated without a tool, to a release tubing producing a connection to said compressed gas unit.

16. An avalanche life saving system comprising:

at least one inflatable buoyancy body of balloon design secured close to a user's body, a filling unit mounted inside the at least one inflatable buoyancy body, a compressed gas unit with a compressed gas container, and a release mechanism attachable to and detachable from said compressed gas unit without a tool via a quick coupling device and a release tubing, wherein said release mechanism further comprises a chamber for producing a controlled pressure wave for initiation of fluid communication between said compressed gas container and said filling unit.

17. An avalanche life saving system in accordance with claim 16, wherein said chamber further comprises a slide member removably inserted within said chamber.

18. An avalanche life saving system in accordance with claim 17, wherein said slide member is biased by a spring disposed within said chamber upon actuation of said release member and wherein said slide member is further adapted to receive a force-generating member that generates said controlled pressure wave upon actuation of said release mechanism.

19. An avalanche life saving system in accordance with claim 16, wherein said release mechanism further comprises indicia viewable by a user to indicate actuation of said release mechanism.

20. An avalanche life saving system in accordance with claim 18, wherein said force-generating member further comprises an explosive cartridge.

21. An avalanche life saving system in accordance with claim 18, wherein said force-generating member is adapted for generating a one-time pressure wave upon actuation of said release mechanism.

22. An avalanche life saving system in accordance with claim 16, wherein said release mechanism is in fluid communication with said compressed gas unit.

23. A release mechanism for an avalanche life saving system, said system comprising at least one inflatable buoyancy body of balloon design secured close to a user's body, a filling unit in fluid communication with said at least one buoyancy body, a compressed gas unit with a compressed gas container in fluid communication with said filling unit and a release tubing connecting said compressed gas unit with said release mechanism, said release mechanism comprising:

a chamber having a first end and a second end, a sliding member disposed within said chamber, a biasing member attached to said first end for biasing said sliding member toward said second end, and a plug member for releasably retaining said sliding member between said first and second ends, whereupon actuation of said release mechanism, said sliding member is released from said plug member and is biased toward said second end resulting in the production of a pressure wave within said chamber which is transmitted via said release tubing to said compressed gas unit for the initiation of fluid communication between said compressed gas container and said filling unit.

24. A release mechanism in accordance with claim 23, further comprising a force generating unit disposed on said sliding member for the generation of said pressure wave.

25. A release mechanism in accordance with claim 24, wherein said force generating unit is an explosive cartridge and said second end further comprises a pin for actuating said cartridge upon contact therewith.

* * * * *